US006367154B2

(12) United States Patent
Degabli

(10) Patent No.: US 6,367,154 B2
(45) **Date of Patent: *Apr. 9, 2002**

(54) COMBINATION UTILITY KNIFE

(76) Inventor: Arie Degabli, 550 Frontage Rd., Suite 3605, Northfield, IL (US) 60093

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/270,151

(22) Filed: Mar. 16, 1999

Related U.S. Application Data

(60) Provisional application No. 60/116,167, filed on Jan. 15, 1999.

(51) Int. Cl.[7] ..... B26B 1/00; B26B 11/00; B25F 1/00

(52) U.S. Cl. ..... 30/123; 30/162; 30/294; 7/163; 7/164

(58) Field of Search ..... 30/123, 335, 293, 30/294, 289, 317, 162; 7/163, 164

(56) References Cited

U.S. PATENT DOCUMENTS 4,255,856 A * 3/1981 Mackie ..... 30/293
4,974,320 A * 12/1990 Pelletier ..... 30/123
4,993,093 A * 2/1991 Goldwitz ..... 7/163
5,206,965 A * 5/1993 Rowley ..... 30/125
5,289,637 A * 3/1994 Coffey ..... 30/294
D372,183 S * 7/1996 Bourque ..... D8/98
5,542,184 A * 8/1996 Beard ..... 30/293
5,966,820 A * 10/1999 Cornacchio et al. ..... 30/293

* cited by examiner

*Primary Examiner*—M. Rachuba
(74) *Attorney, Agent, or Firm*—Mary E. Dicig

(57) ABSTRACT

The present invention is a utility knife adapted for measuring by incorporating a pair of hooks into the blade end of the handle of a common utility knife, which hooks are designed to removably secure the tab of a spring-biased measuring tape such that the tape may extend roughly laterally from the knife but also roughly parallel to the surface being cut. The angles of the hook relative to the knife end are designed to correct for measuring inaccuracies created by the distance that the knife blade must be held away from the surface to be cut; the invention allows the printed measuring surface of the tape measure to remain roughly parallel to the surface being cut, allowing for great ease in reading the measurements during cutting.

2 Claims, 1 Drawing Sheet

COMBINATION UTILITY KNIFE

PRIORITY APPLICATION

This invention claims the benefit of U.S. Provisional Application Ser. No. 60/116167, filed on Jan. 15, 1999.

FIELD OF THE INVENTION

The invention relates to utility knives, and more particularly, utility knives adapted to be conveniently used with tape measures.

BACKGROUND OF THE INVENTION

Utility knives are well known in the art and used for a wide variety of cutting needs. In general, a utility knife includes a handle and a removable cutting blade. Utility knife handles have been constructed in a number of different shapes, most shapes being generally designed to fit comfortably in the hand during cutting. The handles generally include a 2-part housing which is held together with screws and which contains a hook for removably inserting a blade. The blades are either fixed in a position partly extending from the handle, or may be retracted into the handle from an extended position. In using the utility knife for cutting, the user grasps the knife in one hand, applies the cutting edge of the blade to the material to be cut, then applies simultaneous drawing and pushing forces on the blade.

In some applications, the cuts from the utility knife must be precisely placed. For instance, plasterboard (also known as drywall or sheetrock) is a common wall material that is generally sold in sheets sized 4 feet by 8 feet. When attaching these sheets to studs to form a wall, it is often necessary to cut a strip off the side of the plasterboard sheet, for example, for installation in a corner of a room or to form a soffit. Also, quite often, the space in which the plasterboard is to be applied is irregular in shape, requiring difficult and precise cuts for optimal area coverage. A skilled user conventionally makes such cuts by simultaneously operating a tape measure along with the knife.

For instance, when cutting plasterboard using conventional means, the user holds the tab of a tape measure against the handle of the utility knife with his or her thumb, as close to the surface to be cut as possible. The user then extends the tape measure across the plasterboard sheet to the desired distance with the opposite hand. Then, with the tape measure reel in one hand and the knife and tape measure tab in the other, the user will simultaneously slide both the knife and the measuring tape down the sheet to score a line in the plasterboard. The tape measure is then set aside, and a deeper final cut is made along the score line. The strip to be removed is then bent with respect to the remainder of the sheet until it snaps.

This method suffers from a number of drawbacks, however. Because it is difficult to apply sufficient pressure to the knife while holding the tape measure, the user must make two cuts in the plasterboard; if the user presses too hard during the first cut, there is a risk of injury and that an inaccurate cut will be made. Thus, the first cut is generally not sufficiently deep for performing the function of creating a score deep enough for bending the plasterboard, and a second cut is generally needed. Also, when measuring and scoring, the measurement is inaccurate by the distance between the knife blade and the end of the ruler, which must be estimated and accounted for by the user. In addition, the tape measure tab is awkward and uncomfortable to grasp during cutting. Also, if the tape measure tab slips from the user's grasp during cutting and the tension between the blade and the measure is changed, the blade will generally deflected from its desired course and create inaccurate or jagged cuts. Lastly, placing one's thumb so near the cutting surface of the blade during operation of the knife subjects the user to unnecessary levels of risk of cutting the fingers.

Several prior art inventions attempted to overcome these risks. One such invention is a utility knife attachment that creates a slot next to the blade whereby the tab from a utility knife may be attached. This invention, however, is attached next to the blade and limits the depth to which the blade may be used for cutting, since materials other than plasterboard, such as foam insulation, are also cut by utility knives. In addition, it is necessary to carry a small part in addition to the utility knife. Lastly, in order to install and remove the part, the utility knife must be disassembled. Another prior art device includes a slot for receiving a tape measure tab that is formed in the backbone of a utility knife, wherein the tape measure is held parallel to the cutting edge of the blade of the utility knife. This device creates cuts that are inaccurate in that the measure is held away from the wall and almost perpendicular to the wall, causing the user to estimate and account for these inherent inaccuracies in measurement. Moreover, where the rule surface of the measure is not parallel to the surface to be cut, the rule may be difficult to read, leading to mistakes in measurement.

Thus, it is a principal object of the invention to provide a utility knife which is capable of cooperating with a tape measure to allow the cutting blade to be positioned accurately.

It is another object of the invention to provide a means for simultaneous cutting with a utility knife and accurate measuring which will allow the user the user to keep his fingers away from the blade.

It is yet another object of the invention to provide a convenient means for simultaneous cutting of plasterboard and measuring with a tape measure.

It is also an object of the invention to provide a means for simultaneous measuring and cutting where the rule surface of the measure remains parallel to the surface of the material to be cut.

Other objects and variations of the invention will be obvious to those skilled in the art and are included within the scope of the invention.

SUMMARY OF THE INVENTION

The present invention overcomes the drawbacks in the prior art by incorporating a pair of hooks into the blade end of the handle of a common utility knife, which hooks are designed to removably secure the tab of a spring-biased measuring tape such that the tape may extend roughly laterally from the knife but also roughly parallel to the surface being cut.

The angles of the hook are designed to correct for measuring inaccuracies created by the distance that the knife blade must be held away from the surface to be cut; the invention allows the printed measuring surface of the tape measure to remain roughly parallel to the surface being cut, allowing for great ease in reading measurements from the ruler during cutting. The positioning of the hooks near the bottom surface of the knife and very close to the end of the knife allows for the tape to be in very close proximity and parallel orientation to the surface to be cut, thus improving the visibility of the measuring surface and the accuracy of the measurement over prior art devices. In addition, the hooks minimize the need for the user to place his fingers alongside the cutting surface of the blade. Also, the hook of the invention allows the blade to be inserted to its full depth. Lastly, the utility knife of the invention distributes the pulling forces created by extending the tape measure during cutting evenly throughout the housing than would be obtained by a device which attaches to a blade.

Although the angled hooks may be formed in a variety of locations or in a variety of configurations, the preferred embodiment of the present invention employs a generally inverted triangular hook formed in the bottom surface of both halves of the housing. Positioned thusly, the user may comfortably grasp the handle of the knife in a natural manner while the measuring tape remains close to the surface to be measured, and the rule remains approximately parallel to the surface to be measured and thus clearly visible to the user. In addition, this position will not interfere with the retraction mechanism of a retractable utility knife.

The hook may be sized to accommodate almost all commercially available tape measure tabs which are inserted and removed with a simple sliding action, thus creating a fast and smooth use.

Although the preferred embodiment will be set forth in greater detail below, other features and embodiments will the obvious to one skilled in the art. Such features and embodiments are within the scope of this invention.

BRIEF DESCRIPTION OF THE PREFERRED EMBODIMENTS

Figure 1:
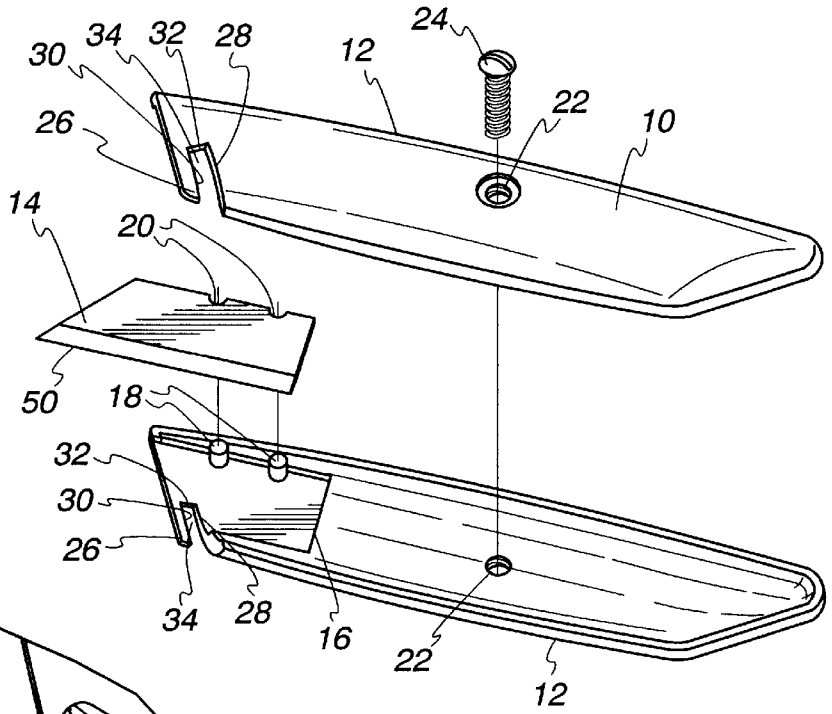
FIG. 1 is a schematic view from the side of a utility knife having the measuring tape hooks of the invention.

Referring first to FIG. 1, a utility knife 10 of the present invention is shown including a housing 12, and a cutting blade 14. The invention contemplates that any utility knife design and blade are suitable for use with the invention. For exemplary purposes only, a conventional housing 12 is shown with a conventional removable blade 14. However, the invention is equally suitable for use with conventionally designed retractable blade utility knives as well.

As depicted in FIG. 1, each half of the housing 12 contains a blade receptacle 16. The blade receptacle 16 contains a plurality of pegs 18, of which two are the current commercial standard. The knife 10 is used with the blade 14 extending from the housing, although for storage the blade may optionally be retractable. The blade 14 is fitted with notches 20, which correspond to pegs 18 within the blade hook. When the blade 14 is properly inserted into the receptacle 16, the blade notches 20 fit around the pegs 18 to properly orient the blade 14 within the housing 12. The two halves of the housing 12 contain a fastening means, here shown as a screw 24 to be inserted into threaded screw holes 22. The halves are fitted together and fastened with a fastening means such as a screw 24 inserted into the screw hole 22 and tightened.

Figure 2:
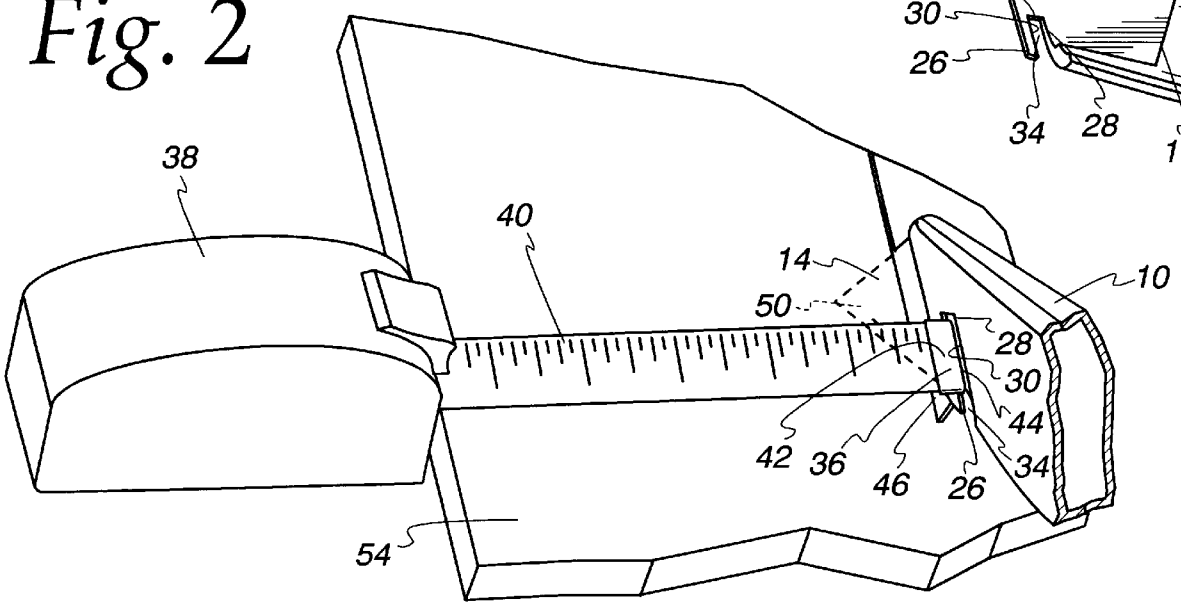
FIG. 2 is a perspective view showing the knife of the invention during use in combination with a tape measure.

In accordance with the present invention and as shown in FIGS. 1 and 2, each part of the housing 12 incorporates a hook 26, the hook and the housing defining a space having two sides 28 and 30 and an apex 32. Side 28 is parallel with respect to side 30 and sides 28 and 30 and apex 32 define a space 34 which is used to insert a measuring tape tab 36. Side 30 forms an edge against which the measuring tab 36 rests during use of the knife 10 and measuring tape 38 in accordance with the principles of the invention.

In the preferred embodiment, the hooks 26 comprise two juxtaposed openings in the side and bottom of the housing. Each hook 26 is used independent of the other, and together the two hooks 26 provide for greater flexibility in measuring from each side of the knife.

In FIG. 2, the cooperative engagement of the knife 10 of the present invention with a conventional measuring tape 38 is depicted. In its conventional form, a measuring tape 38 incorporates an elongated ruler portion 40 which includes a right-angled tab 36 mounted to the end of the ruler portion 40. Typically, tab 36 contains a mounting portion 42, a flange 44 and a tab 46. The mounting portion 42 is affixed to the ruler portion 40 in order to position the flange 44 as the "zero" point of the ruler.

In using the present invention, the tab 46 is quickly and easily engaged by the hook 26 so that the flange 44 is resting upon side 30, and the tab is in abutting engagement with the hook.

With the flange 44 retained by the hook 26, the zero position of the measuring tape is very close to the cutting surface 50 of the blade 14. Moreover, because of the substantially parallel orientation of sides 30 and 28 with respect to angled end of the housing from which the blade extends, the ruler portion 40 of the measuring tape 38 is held closely parallel to the surface to be cut 54, minimizing measuring inaccuracies resulting from the measuring tape 38 being held either at an angle to the surface to be cut, or farther away from the surface to be cut 52.

As used herein, the "surface to be cut" includes any surface for which the invention would have utility, including but not limited to plasterboard, sheetrock, cement board, laminates, paneling, wood sheets and the like. Conveniently, the hooks 26 are located on both sides of the knife 10, facilitating precise measurement extending laterally from both sides of the housing.

It is thus seen from the above description of a preferred embodiment that the objects of the invention are attained. Variations on this embodiment will be apparent to those skilled in the art without departing from the scope of the invention. All matter contained in the above description and the accompanying drawings is intended to be illustrative of the invention, and not limiting in the scope of the invention.

What is claimed is:

1. A utility knife comprising:

a two-part housing wherein the two parts are first and second juxtaposed halves, the housing having a top and a bottom, with each half having an angled blade end and a back end, which angled blade end and back end form a front and a back of the housing, respectively, wherein the longitudinal axis of the housing extends from the front to the back;

a blade removably engaged within the housing and extending outward from the angled blade end, the blade having a cutting edge extending outward along the bottom of the housing;

first and second juxtaposed hooks in the angled blade ends of the first and second halves respectively wherein each hook forms an opening extending from the bottom of the housing toward the top, each opening being defined by a first side, a second side and an apex, wherein the openings and the sides are in substantially parallel alignment to the angled blade end.

2. The utility knife of claim 1 wherein the blade is retractable.

* * * * *